United States Patent [19]

Famolare, Jr.

[11] Patent Number: 4,779,359

[45] Date of Patent: Oct. 25, 1988

[54] SHOE CONSTRUCTION WITH AIR CUSHIONING

[75] Inventor: Joseph P. Famolare, Jr., New York, N.Y.

[73] Assignee: Famolare, Inc., New York, N.Y.

[21] Appl. No.: 79,650

[22] Filed: Jul. 30, 1987

[51] Int. Cl.[4] ..... A43B 13/18; A43B 13/20

[52] U.S. Cl. ..... 36/29; 36/28

[58] Field of Search ..... 36/11.5, 28, 29, 88, 36/93, 3 R, 33, 32 R; 128/594

[56] References Cited

U.S. PATENT DOCUMENTS

| | | | |
|---|---|---|---|
| 541,814 | 6/1895 | King | 36/29 |
| 580,501 | 4/1897 | Mobberley | 36/29 |
| 1,605,985 | 11/1926 | Rasmussen | 36/29 |
| 3,160,963 | 12/1964 | Aaskon | 36/29 |
| 3,936,956 | 2/1976 | Famolare, Jr. | 36/32 R |
| 3,990,457 | 11/1976 | Voorhees | 128/594 |
| 4,115,934 | 9/1978 | Hall | 36/29 |
| 4,124,946 | 11/1978 | Tomlin | 36/11.5 |
| 4,342,157 | 8/1982 | Gilbert | 36/29 |
| 4,446,634 | 5/1984 | Johnson et al. | 36/29 |
| 4,657,716 | 4/1987 | Schmidt | 36/29 |

FOREIGN PATENT DOCUMENTS

| | | | |
|---|---|---|---|
| 69042 | 12/1892 | Fed. Rep. of Germany | 36/29 |
| 2813579 | 10/1979 | Fed. Rep. of Germany | 36/11.5 |
| 284366 | 4/1931 | Italy | 36/29 |
| 7441 | of 1906 | United Kingdom | 36/29 |
| 2023405 | 1/1980 | United Kingdom | 36/29 |

*Primary Examiner*—Steven N. Meyers

*Attorney, Agent, or Firm*—Robin, Blecker & Daley

[57] ABSTRACT

A shoe construction wherein a shoe sole is provided with an upper surface which conforms to the anatomical contour of the undersurface of the human foot and wherein air-pocket members are distributed along the length of the upper surface and are incorporated into the respective toe, ball, shank and heel regions of the sole in such a manner as to preserve at least a skeleton of the anatomical upper surface of the sole.

7 Claims, 1 Drawing Sheet

SHOE CONSTRUCTION WITH AIR CUSHIONING

BACKGROUND OF THE INVENTION

This invention relates to shoe constructions and, in particular, to shoe constructions which employ air-cushioning in the sole of the shoe for absorbing shocks.

The utilization of air-cushioning in shoe constructions has been around for many years. In early shoe constructions of this type, air-cushioning was typically provided by incorporating bladders or bags into the shoes at various locations. These bladders or bags were, in turn, provided with accessible valves for coupling to a source of air for filling the bags. Shoe constructions of this type are disclosed, for example, in U.S. Pat. Nos.: 508,034; 541,814 and 2,532,742.

In more recent shoe constructions, shoe designers have attempted to realize air-cushioning by utilizing a layer or layers of material to create cushioning compartments along the length of the shoe. U.K. patent application No. 2,050,145A discloses one such type of shoe construction wherein upper and lower pliable layers are welded along their peripheries and across their width to define a variety of independently inflatable air-pockets.

The above prior art shoe constructions, while they have provided some degree of cushioning effect, have also suffered from a variety of disadvantages. This has prompted shoe designers to look for alternative air-cushioned shoe constructions.

It is therefore an object of the present invention to provide an improved air-cushioned shoe construction.

It is a further object of the present invention to provide a air-cushioned shoe construction wherein orthopedic support and comfort are preserved.

SUMMARY OF THE INVENTION

In accordance with the principles of the present invention, the above and other objectives are realized in a shoe construction wherein a shoe sole is provided having an upper surface which follows the anatomical contour of the undersurface of the human foot and wherein air-pocket members are incorporated into the sole along its length and in spaced relationship from each other and from the peripheral edge of the sole so to preserve at least a skeleton of the anatomical surface. With the shoe sole of the invention configured as aforesaid, shock to the foot of the user is alleviated via the air-pocket members, while the orthopedic nature of the sole is maintained via the anatomical skeleton.

In the particular embodiment of the invention to be disclosed herinafter, the upper surface of the sole has a forwardmost toe region, an intermediate ball region, an intermediate shank region and a rearmost heel region. An air-pocket member is situated in each of these regions in spaced relationship from the periperal edge of the surface and in spaced relationship from the air-pocket members in the adjacent regions. The surface portions between the air-pocket members and between the air-pocket members and the peripheral edge thus define the anatomical skeleton.

DESCRIPTION OF THE DRAWINGS

The above and other features and aspects of the present invention will become more apparent upon reading the following detailed descriptipn in conjunction with the accompanying drawings, in which.

DETAILED DESCRIPTION

Figure 1:
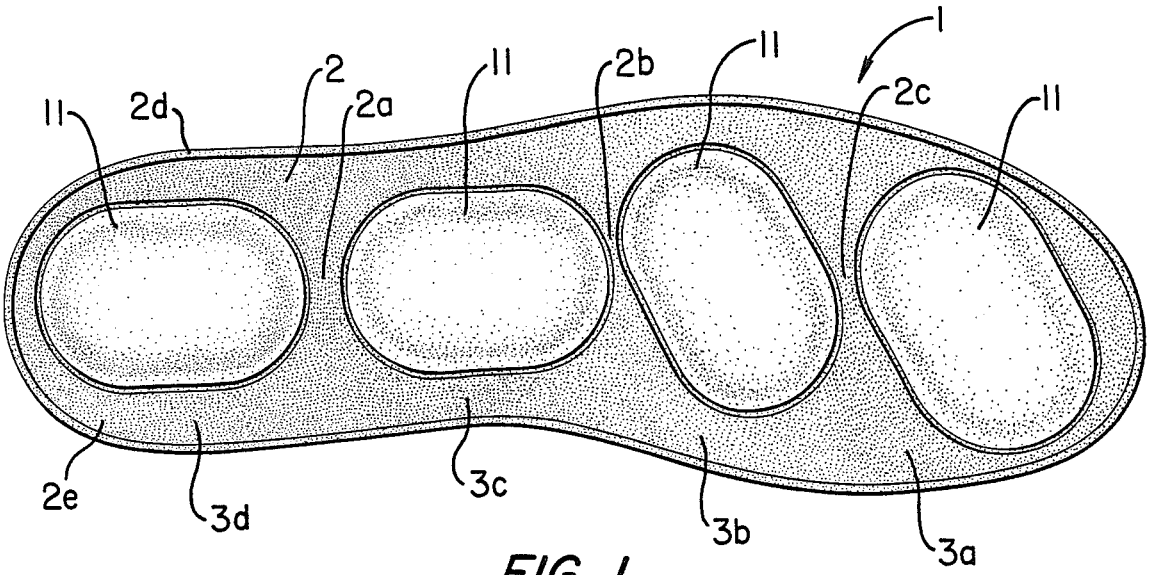
FIG. 1 shows a top plan view of the sole of a shoe construction in accordance with the principles of the present invention.
Figure 2:
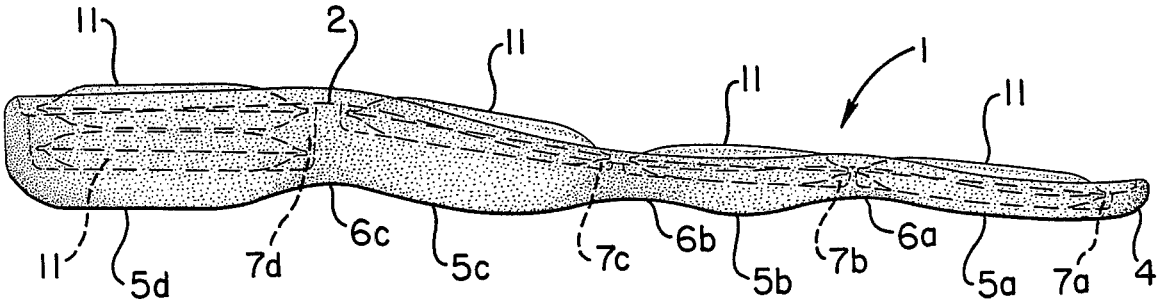
FIG. 2 illustrates a side view of the sole of FIG. 1.

FIG. 1 shows a shoe sole 1 of a shoe construction in accordance with the principles of the present invention. As shown, the sole 1 is in the form of a body of resilient material, such as, for example, latex rubber or the like. The sole has upper and lower surfaces 2 and 4 and defines a forwardmost toe region 3*a*, an intermediate ball region 3*b*, an intermediate shank region 3*c* and a rearmost heel region 3*d*. These regions are commensurate with the primary bone regions of the human foot, i.e., the toe, ball, shank and heel regions of the foot, repectively.

In the embodiment of the invention shown in FIG. 1, the lower surface 4 of the sole has crest regions 5*a*, 5*b*, 5*c* and 5*d* which alternate with valley regions 6*a*, 6*b* and 6*c*. The crest regions 5*a*–5*d* underly the toe, ball, shank and heel regions 3*a*–3*d*, respectively, of the sole and provide ground contacting surfaces therefor.

The upper surface 2 of the sole 1 is orthopedic in character and adapted to follow the anatomical contour of the undersurface of the human foot over both its length and its width. This makes the shoe construction more comfortable and better able to correctly support the user's foot.

In accordance with the principles of the present invention, the shoe sole 1 is further adapted to provide an air-cushioned shock absorbency to the sole in a manner which maintains the afore-mentioned orthopedic character of the sole. More particularly, this is accomplished by incorporating into the sole along its length, air-pocket members 11 which are arranged in such a way as to preserve at least a skeleton of the anatomical upper surface 2.

Preservation of this anatomical skeleton tends to preserve the orthopedic nature of the surface contacted by the user's foot. This occurs because the presence of the skeleton causes the usual lining (not shown) overlying the upper surface 2 and in contact with the user's foot to tend to adhere to the anatomical surface even in the presence of the air-pocket members 11, the latter being compressed under the pressure of the foot during use of the sole. Accordingly, the sole 1 of the present invention acts both as a shock absorber and to provide comfort and the required support for the user's foot. Furthermore, the sole 1, due to the skeleton, maintains its rigidity so that pronation, i.e., turning in of the foot, is also prevented.

In the present illustrative case, the air-pocket members 11 are spaced from each other by the respective transverse upper surface regions 2*a*–2*c* (these regions underly the cartilage areas of the foot) and from the peripheral edge 2*d* of the upper surface by the upper rim surface region 2*e*. The combination of these upper surface regions, in turn, define the anatomical skeleton of the upper surface.

As can be seen, the upper surface 2 is provided with cavities 7*a*–7*d* in the respective regions 3*a*–3*d* of the sole to accomodate the air-pocket members 11. These cavities are of a depth to allow the respective air-pocket members 11 to protrude above the surface 2.

As shown, two air-pocket members 11 are disposed in the heel region 3*d* of the sole 1, while a single air-pocket member 11 is disposed in each of the shank, ball and toe regions 3*a*–3*c*.Only a single pocket member 11 is used in each of the latter cases because a lesser amount of cushioning is desired in the associated regions of the sole as compared to the heel region. Furthermore, the cavity *7d* is of greater depth than the cavities *7a*–*7c*, since the cavity *7d* must accomodate two of the pocket members.

Each air-pocket member 11 may be held in its respective cavity by gluing. Furthermore, the stacked members may also be glued together to inhibit relative movement.

Figure 3:
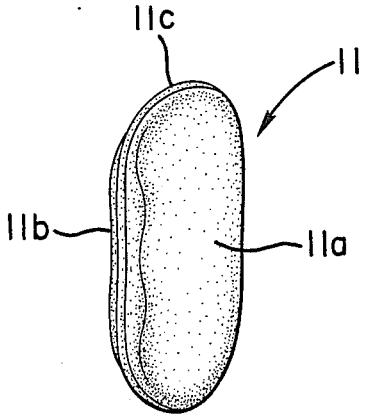
FIG. 3 shows one of the air-pocket members utilized with the sole of FIGS. 1 and 2.

FIG. 3 shows a single one of the air-pocket members 11 utilized in the sole of FIG. 1. The air-pocket member 11 comprises two plastic (e.g. polyvinyl chloride) layers 11*a* and 11*b* which have been welded about their peripheries 11*c* to create a pocket in which there is air. As shown, each air-pocket member 11 has a longer length dimension than its width dimension and its corners are rounded.

In the sole of FIG. 1, the the air-pocket members 11 are all of substantially the same configuration and all hold substantially the same amount of air. This facilitates fabrication of the members. As also shown in FIG. 1, the air-pocket members 11 in the regions 3*a* and 3*b* have their length dimensions substantially angled or transverse relative to the length dimension of the sole. The length dimensions of the air-pocket members in the regions 3*c* and 3*d*, on the other hand, are substantially parallel to the length dimension of the sole. This configuration facilitates cushioning under desired portions of the user's foot.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention. In particular, while the pocket members 11 have been illustrated as being of substantially uniform configuration and holding substantially equal amounts of air, pocket members of different configurations holding different amounts of air may also be utilized.

What is claimed is:

1. A shoe construction comprising:

a shoe sole having upper and lower surfaces, the upper surface over the length and width of the upper surface following the anatomical contour of the undersurface of the human foot and the sole defining a forwardmost toe region, an intermediate ball region, an intermediate shank region and a rearmost heel region; and air pocket members distributed over the length of said sole such that an air-pocket member is incorporated into each of said regions, each of said air pocket members being a unitary structure independent of the other air-pocket members and formed from top and bottom layers welded about their peripheries, each of the air-pocket members in each region being spaced from the air pocket members in the adjacent regions and from the peripheral edge of said upper anatomical surface, said spacing between the air-pocket members and between the air-pocket members and the peripheral edge of the anatomical upper surface forming a skeleton of the anatomical surface, whereby said shoe sole provides cushioning and orthopedic support to the user's foot.

2. A shoe construction in accordance with claim 1 wherein:

said upper surface includes at each location at which there is an air-pocket member a cavity in which said air-pocket pocket member is disposed.

3. A shoe construction in accordance with of claim 2 wherein:

a single air-pocket member is incorporated into each of said toe, ball, and shank regions;

and stacked first and second air-pocket members are incorporated into said heel region.

4. A shoe construction in accordance with claim 2 wherein:

said air-pocket members each have a longitudinal extension and a lateral extension, said air-pocket members in said said heel and shank regions having their longitudinal extensions along the length of said shoe sole and said pocket members in said ball and toe regions having their longitudinal extensions angled relative to the length of said shoe sole.

5. A shoe construction in accordance with claim 4 wherein:

the lower surface of said shoe sole comprises first, second, third and fourth crest regions connected by valley regions, said first, second, third and fourth crest regions underlying said toe, ball, shank and heel regions, respectively.

6. A shoe sole in accordance with claim 5 wherein:

said air-pocket members are of substantially the same configuration and hold substantially the same amount of air.

7. A shoe construction in accordance with the claim 2 wherein:

the air-pocket members when supported in their respective cavities extend above the upper surface.

* * * * *